US008864607B2

(12) United States Patent
Ernst

(10) Patent No.: US 8,864,607 B2
(45) Date of Patent: Oct. 21, 2014

(54) GOLF TRAINING AID

(71) Applicant: Darren Ernst, Huntington Beach, CA (US)

(72) Inventor: Darren Ernst, Huntington Beach, CA (US)

(73) Assignee: Team Ernst Golf, LLC., Huntington Beach, CA (US)

( * ) Notice: Subject to any disclaimer, the term of this patent is extended or adjusted under 35 U.S.C. 154(b) by 0 days.

(21) Appl. No.: 13/674,574

(22) Filed: Nov. 12, 2012

(65) Prior Publication Data

US 2014/0100046 A1 Apr. 10, 2014

Related U.S. Application Data

(60) Provisional application No. 61/709,821, filed on Oct. 4, 2012.

(51) Int. Cl.
*A63B 69/36* (2006.01)
*A63B 57/00* (2006.01)

(52) U.S. Cl.
CPC ..... *A63B 57/0075* (2013.01)
USPC ..... 473/409

(58) Field of Classification Search
USPC ..... 473/218, 219, 257, 261, 266, 268, 270, 473/278, 409
See application file for complete search history.

(56) References Cited

U.S. PATENT DOCUMENTS

| | | | | | |
|---|---|---|---|---|---|
| 3,459,429 | A * | 8/1969 | Green | 473/218 |
| 4,384,718 | A | 5/1983 | Cachola | |
| 4,583,739 | A * | 4/1986 | Kabbany | 473/218 |
| 5,163,686 | A * | 11/1992 | Bergman | 473/218 |
| 5,306,011 | A * | 4/1994 | Perry | 473/218 |
| 5,478,082 | A * | 12/1995 | De Knight et al. | 473/218 |
| 5,645,494 | A * | 7/1997 | Dionne et al. | 473/278 |
| 5,944,613 | A | 8/1999 | Dubois | |
| 5,984,801 | A | 11/1999 | Mason | |
| 6,592,376 | B1 * | 7/2003 | Carpenter | 434/252 |
| 7,214,146 | B1 * | 5/2007 | Gersang | 473/409 |
| 7,892,104 | B2 | 2/2011 | Laden | |
| 2005/0227774 | A1 * | 10/2005 | Buck | 473/218 |
| 2006/0094519 | A1 * | 5/2006 | Wynne | 473/218 |

* cited by examiner

*Primary Examiner* — Nini Legesse
(74) *Attorney, Agent, or Firm* — Stetina Brunda Garred & Brucker; Lowell Anderson

(57) ABSTRACT

A golf training aid has an elongated alignment guide. A plurality of club markings extends along a first edge of the guide. The club markings indicate the position of a golf ball along the guide when the ball is struck with a club corresponding to the marking. The club markings include markings for drivers, fairway woods, hybrids, irons and wedges. Sets of paired foot markings extend along the second edge. The paired foot markings are centered on one of the club markings and are equally spaced along the length of the guide from the centered club marking, with each pair of foot markings being spaced apart by a fixed distance larger than the prior pair.

5 Claims, 2 Drawing Sheets

GOLF TRAINING AID

CROSS-REFERENCE TO RELATED APPLICATIONS

Application claims priority to Provisional Patent Application No. 61/709,821 filed Oct. 4, 2012 the entire contents of which are incorporated herein by reference.

BACKGROUND

While it is relatively easy to hit a golf ball, it is difficult to hit the ball consistently and well. Slight alterations in the position and orientation a golfer's body when swinging a club to hit the ball can greatly affect the distance the ball travels after being hit, and the direct of travel. Likewise, the club with which the ball is hit greatly affects the distance and direction the ball travels. Many of these training aids and methods address different aspects of swinging the golf club to hit the ball. Some focus on the swing of the club, some focus on the body and arm position as the club swings, some focus on the grip of the club, some focus on the club used and the club design, some focus on the position of the feet and body relative to the ball and orientation of the club. These numerous training aids include those disclosed in U.S. Pat. Nos. 4,384,718, 5,944,613, 5,984,801 and 7,892,104.

Many of these training aids include so many aspects of gripping the club, swinging the club and hitting the ball that they are complex to understand and difficult to use, let alone use consistently. Many of these training aids involve moving parts making them large, bulky, difficult to assemble and use, reduce portability, and are subject to breakage. Many of these training aids are also complex to make and confusing to use. There is thus a need for a training aid that is has no moving parts, that is simple to understand and simple to use so that golfers can consistently use the training aid to improve their performance. There is also a need for a simple device that selects a few of the many variable that affect hitting the golf ball and present them in a simply understood manner that may be consistently applied so as to improve a golfers performance.

BRIEF SUMMARY

An alignment guide is provides that comprises a straight member about 2-5 feet long. The alignment guide may have a flat side that rests on the golf course during use, with one end of the guide having orienting indicia to be aligned with the desired direction the golf ball is to travel when hit. The upward facing surface of the alignment guide has a series of club markings indicative of the type of golf club used to hit the golf ball. The club markings may be along one edge of the alignment guide, preferably along the edge that is closest to the golf ball and farthest from the golfer during use. The club markings may include markings for drivers, fairway woods, four-irons and hybrid clubs, angled irons of various inclination from 5-9 or higher, and the wedges such as the pitch wedge, swing wedge, loft wedge clubs, and specialty shots or specialty club heads requiring even higher loft on the ball when struck or other club head configurations not encompassed by the above specified club heads. Some of the club markings may optionally overlap, such as the swing wedge and loft wedge, and the 8 and 9 irons and the pitch wedge. The club markings may be specifically marked locations or they may be short lengths along the edge, or both.

On the opposing edge of the alignment guide is a plurality of foot markings. The foot markings are on the side or edge of the alignment guide that is farthest from the ball and closest to the golfer during use. The foot markings may form two groups of markings, a left group and right group, corresponding to a golfer's left and right foot, respectively, during use. The foot markings in each group are equally spaced, with spacing of about one inch believed suitable. Each foot markings the left group is visually coordinated to correspond with a foot marking in the right group, such that the closest markings in each group correspond, and the most distant markings correspond, as do the ones in between.

The foot markings are positioned relative to the club markings and are preferably centered on the location for one of the angled irons, preferably the 8 or 9 iron. Thus, the innermost foot markings may be equal-distant from the club marking for the 8-9 iron and on the opposing side or edge of the alignment guide, with successive foot markings extending toward opposing ends of the alignment guide at equal increments of about 1 inch. The closest foot markings in each group may be about one foot apart with the farthest foot markings being 24-28 inches apart, although other minimum and maximum spacing may be used.

In use, a golfer lays the alignment guide on the ground and points the alignment end toward the location the ball is desired to travel, say the flag in the cup of the first hole for illustration. For right handed golfers the alignment end would be the left end of the guide. The golfer places the golf ball along the length of the alignment guide at the location that corresponds with the club being used to hit the ball, say the driver for illustration. The ball is places a few inches away from the alignment guide to avoid striking the guide, with a distance of about three inches believed suitable. The golfer places his or her feet so each foot is aligned with corresponding foot markings in the left and right group and the same distance from the alignment guide. Visual positioning and alignment are believed sufficient. The golfer then moves toward or away from the alignment guide a distance suitable or comfortable for the golfer to address and strike the ball, while maintaining the left and right foot in alignment with the corresponding foot marking indicia. Visual positioning and alignment are believed sufficient. The golfer then swings the club and hits the ball.

The alignment end and the length of the alignment guide help orientate the golfer relative to the desired ball trajectory if the ball were hit straight. The alignment guide acts as an arrow pointing toward the goal (the first hole). The club guide club aligns the ball with the desired trajectory for the desired club being used to strike the ball. The foot markings align the golfer's body relative to the ball and help ensure an equally positioned stance relative to the alignment guide and thus relative to the ball and club guide, and further relative to the alignment guide and the desired trajectory of the ball if hit straight. Consistent use of the alignment guide should result in consistent performance when the club is swung consistently. Varying the ball position along the length of the club markings or relative to the discrete club marking should consistently vary the ball trajectory when the club is swung consistently.

By selecting s sub-group of the multitude of parameters that affect the performance of hitting a golf ball, and by organizing those parameters in an alignment guide that is simple to use consistently, the alignment guide is believed to allow a golfer to consistently hit the ball and to improve the golfer's performance.

There is thus advantageously provided a golf training aid that includes an elongated alignment guide having a length with having first and second opposing side edges, opposing upper and lower surfaces, and a first alignment end and an opposing second end. The alignment guide training also has a plurality of club markings on the upper surface at or adjacent to the first side edge and extending along at least a portion of the length of the elongated member and preferably extending along less than a majority of the length (more than half) of the elongated member, and less preferably extending along over half of the length. The club markings include positions for placing a golf ball along the length of the elongated member so the ball may be struck with a club corresponding to the club marking during use of the training aid. The club markings are selected from the group comprising drivers, fairway woods, hybrids, one or more irons, wedges and specialty club heads. The alignment guide further includes a plurality paired foot markings are on the upper surface at or adjacent to the second edge. The paired foot markings are centered on the location for one of the club markings and are equally spaced along the length of the alignment guide from the centered club marking. Each pair of foot markings is spaced apart a distance that is larger than the adjacent pair by a fixed distance. The foot markings preferably extend along a majority (over half) of the length of the alignment guide and less preferably extend along less than half the length of the alignment guide. Preferably, the foot markings extend beyond the club markings on both ends of the club markings.

In further variations, the alignment guide has printed indicia at the alignment end indicating that end is the alignment end. The foot markings may be centered on the location for one of the club markings for irons or specialty wedges, and are advantageously u centered on the location for one of the club markings selected from the group comprising 8 irons, 9 irons, pitch wedge, and specialty wedge. The club markings preferably include drivers, fairway woods, hybrids, one or more irons and wedges, with the foot markings centered on the location for the club marking for the 7, 8 or 9 irons or a wedge.

Moreover, the club markings comprise a marking for drivers having a length of about two inches, a marking for fairway woods having a length of about 1.5 inches, and a marking for a 4 iron or hybrids of about 1.5 inches, all as measured along the first edge. The club markings may al so comprise a marking for drivers having a length of about two inches, a marking for fairway woods having a length of about 1.5 inches, and a marking for a 4 irons or hybrids of about 1.5 inches, and markings for a 5 irons, 6 irons, 7 irons, 8 irons and 9 irons each spaced about 0.5 inches apart as measured along the first edge. Further, in the above club markings, the driver and fairway woods markings are about 1.8 inches apart, the fairway woods and 4 irons markings are about 0.7 inches apart, and a specialty shots marking is about 3 inches from the 4 irons marking with one or more markings for irons or wedges between the 4 irons and specialty shots markings as measured along the first side edge. Moreover, the foot markings are preferably centered on the location for a club marking for irons, with the foot markings having a plurality of pairs of markings, each pair of which has paired markings spaced greater than one foot apart and less than two feet apart.

There is also advantageously provided a method for aligning a golfer with a ball. The method includes the steps of placing an elongated alignment guide on the ground with a longitudinal axis of the alignment guide aligned with the desired trajectory of a golf ball. The alignment guide has a series of club markings along a first edge with the markings identifying the location at which the golf ball should be placed when using a specified club. The club markings include one or more of drivers, fairway woods, 4 iron or hybrids, 5 to 9 irons, wedges, and clubs for specialty shots not included in the other club heads. The method also includes placing a golf ball in the club marking corresponding to the club being used to hit the ball, but offset from the alignment guide by a few inches. The golfer stands on the opposite side of the alignment guide as the ball. The alignment guide has a second side oppose the first side with a plurality of paired foot markings along the second side. The paired foot markings are equidistant from and centered on the location for one of the club markings. The golfer aligns a corresponding location on each of the golfer's feet with a different one of a pair of the foot markings. This completes the alignment method. The golfer may then swing the club and hits the ball. The club markings may markings include a marking for one or more of 8 irons, 9 irons or pitching wedges, and wherein the foot markings are centered on the location for the marking for one of 8 irons, 9 irons or pitching wedges.

BRIEF DESCRIPTION OF THE DRAWINGS

These and other features of the invention will be better understood by referring to the following description and drawings, in which like numbers refer to like parts throughout, and in which.

DETAILED DESCRIPTION

Figure 1:
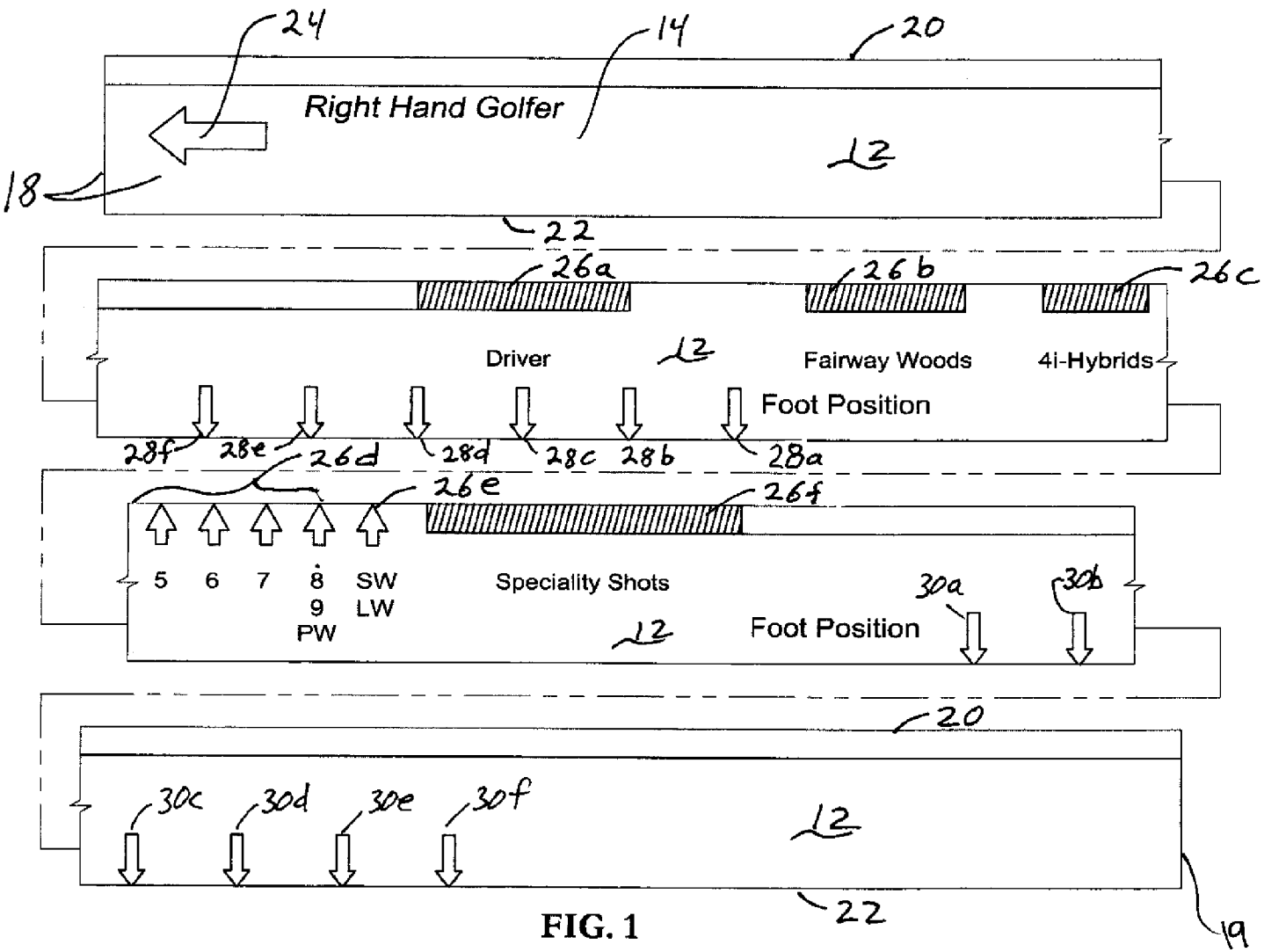
FIG. 1 is an exploded plan view of a first surface of the training aid showing club indicia and foot indicia on the first or top surface.
Figure 2:
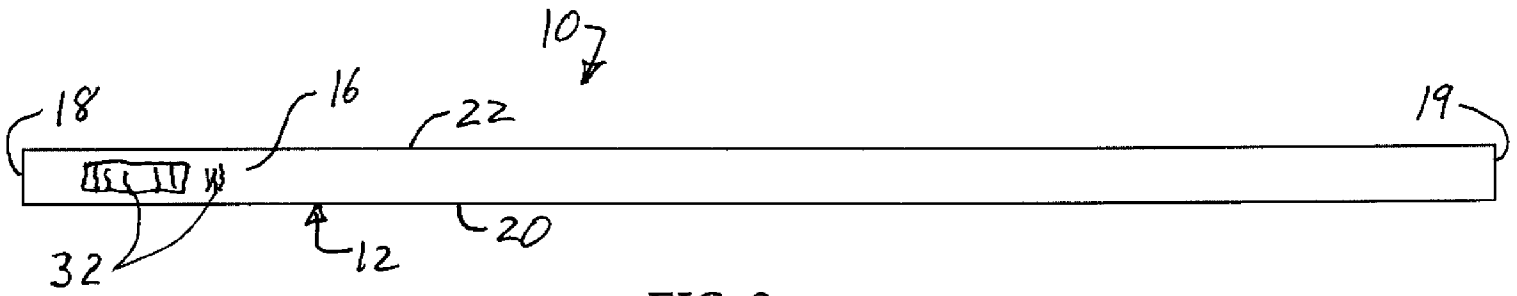
FIG. 2 is a bottom plan view of the training aid of FIG. 1.
Figure 3:
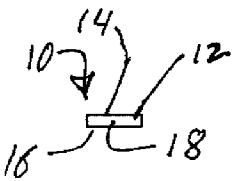
FIG. 3 is an end view of the training aid of FIG. 1, with the opposing end view being the same.
Figure 4:
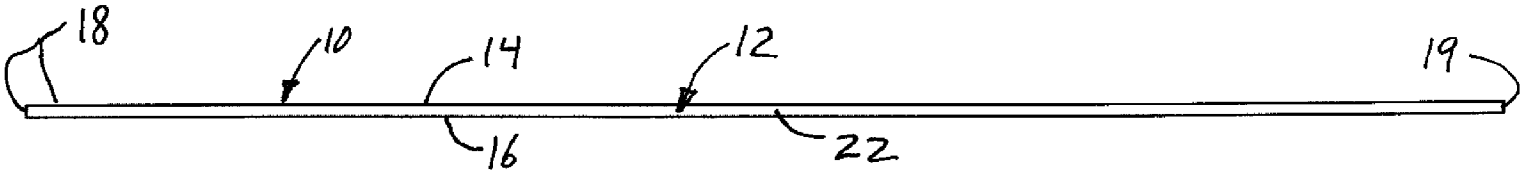
FIG. 4 is a side view of the training aid of FIGS. 7 and 2 with the opposing side view being the same.

Referring to FIGS. 1-4, a golf training aid 10 is shown comprising an alignment guide 12 having an upper surface 14 (FIGS. 1 and 4) and a lower surface 16 (FIGS. 2 and 4). The lower surface 16 is preferably flat so it can rest stably on the ground during use with the upper surface 14 being visible to the golfer during use. The alignment guide 12 is a straight, elongated member having an indicating end 18 and two opposing sides or edges that comprise a club side 20 and a foot position side 22. The alignment guide 12 may have various shapes, with a rectangular shape like a yard-stick believed suitable and shown in the figures, although a length of about a meter (about 40 inches) is preferred.

During use the lower surface of the guide 12 is placed on the ground with the foot side 22 nearer the golfer than the club side 20 with the upper surface 14 visible to the golfer. The upper surface 14 of the alignment guide 12 contains several markings that may be formed in the guide 12 or placed on the surface of the guide 12 and as used herein the term "printed indicia" or "indicia" will encompass both.

Referring to FIG. 1, it is preferable but optional for the alignment guide 12 to have some marking 24 indicating the alignment end of the guide. The depicted marking is an arrow on the upper surface 14 at or near the alignment end 18 in order to indicate the desired direction the golf ball is to travel when hit. The end 18 could be shaped to indicate the alignment end and form the marking 24, as for example, by a pointed end or rounded end.

On the upper surface 14 (and possibly on the edge 20) are a plurality of club markings 26 which are spaced along at least a portion of the length of the alignment guide 12 and preferably extend along a less than half the length of the alignment guide. The length of the alignment guide is determined by the distance from end 18 to end 19, with the length of the markings is measured as the distance between the markings 26 closest to end 18 and the marking closest to end 19. In less preferred embodiments, the length of the club markings is greater than half the length of the alignment guide.

The club markings 26 correspond to the type of golf club used to hit the golf ball during use of the guide 12 and are located differently for a left handed and right handed golfer. The club markings are preferably along one edge of the alignment guide, preferably along the club side 20 that is closest to the golf ball and farthest from the golfer during use. The club markings 26 may include markings 26*a* for drivers, 26*b* for fairway woods, 26*c* for four-irons and hybrid clubs, 26*d* for angled irons of various inclination from 5-9 or higher, 26*e* for wedges such as the pitch wedge, swing wedge, loft wedge clubs, and 26*f* for specialty shots requiring even higher loft on the ball when struck. Some of the club markings 26 may optionally overlap, such as the swing wedge and loft wedge of 26*e*, and the 8 and 9 irons and the pitch wedge of 26*d*.

The club markings may be specifically marked locations as for the 5 iron, 6 iron and 7 iron of 26*d*, or they may be short lengths along the edge as for the driver 26*a*, Fairway Woods 26*b*, 4 iron and hybrids of 26*c*, or specialty shots of 26*f*, or both. In the illustrated embodiment the alignment guide 12 is about 40 inches long and the club marking 26*a* for the drivers is about two inches long, beginning about 13 inches from the square end 18. The club marking 26*b* for the Fairway Woods is about 1.5 inches long and begins about 16 and ¾ inches from square end 18 or about 1 and ¾ inches from the adjacent end of the Driver club marking 26*a*. The club marking 26*c* for the 4 iron and hybrid clubs drive is about one inch long and begins about 19 and ¾ inches from end 18. There are separate club markings 26*d* for each of the 5, 6, 7 and 8 irons with each marking 26*d* being about ½ inch apart and beginning about ½ inch from the end of the 4 iron and hybrid marking 26*c* or about 19 and ¾ inches from end 18. A marking for the 9 iron and the pitch wedge may also be provided at the location of the marking for the 8 iron. The club marking 26*e* for the swing wedge (SW) and loft wedge (LW) clubs is about ½ inch from the marking for the 8 iron, or about 23 and ¼ inches from the end 18. The club marking 26*f* for the specialty shot clubs is about three inches long and begins at about ½ inch from the marking 26*e*, or about 23 and ½ inches from end 18. The remainder of the alignment guide extends about 14 inches from the end of the specialty shots club marking 26*f*.

The depicted club markings 26 are for a right handed golfer as noted by the text adjacent end 18. For a left handed golfer the indicating end 18 would be the same, but the club markings 26 would be on the opposing side of the guide 12 and thus located alongside 22 rather than side 20.

On the upper surface 14 and extending along the edge 20 of the alignment guide 12 opposite the edge 22 are a plurality of foot markings 28, 30. The foot markings 28, 30 are on the side or edge 22 of the alignment guide 12 that is farthest from the ball and closest to the golfer during use. The foot markings 28, 30 advantageously form two groups of markings, a left group 28 and right group 30, corresponding to the location of a golfer's left and right foot, respectively, during use. The depicted embodiment uses six foot markings in each group, corresponding to foot markings 28*a*, 28*b*, 28*c*, 28*d*, 28*e* and 28*f* for the left foot group 28, and similar alphanumeric designations for the right foot marking group 30*a* through 30*f*.

The foot markings 28, 30 in each group are equally spaced, with spacing of about one inch believed suitable. Each foot markings 28 in the left group is visually coordinated to correspond with a foot marking in the right group 30, such that the closest markings in each group correspond, and the most distant markings correspond, as do the ones in between. Thus, the foot markings 28*a*, 30*a* are closest to each other and may be visually designated as corresponding by having the same color, size, shape or other identical or similar visual appearance. For illustration the foot markings 28*a*, 30*a* may be designated by arrows of the same color, say green. The foot markings 28*a*, 30*a* are spaced about 12 inches apart, and are centered roughly opposite the last club marking 26*d* for the 8 iron, 9 iron and pitch wedge clubs, and if that marking is not present then centered on the location for that club marking. The location may be interpolated from the other markings 28.

The foot markings 28*b*, 30*b* are about 14 inches apart and visually correspond as described above. For illustration the foot markings 28*b*, 30*b* may be designated by arrows of the same color, say blue. The foot markings 28*c*, 30*c* are about 16 inches apart and visually correspond as described above. For illustration the foot markings 28*c*, 30*c* may be designated by arrows of the same color, say brown. The foot markings 28*d*, 30*d* are about 18 inches apart and visually correspond as described above. For illustration the foot markings 28*d*, 30*d* may be designated by arrows of the same color, say orange. The foot markings 28*e*, 30*e* are about 20 inches apart and visually correspond as described above. For illustration the foot markings 28*e*, 30*e* may be designated by arrows of the same color, say purple. The foot markings 28*f*, 30*f* are about 22 inches apart and visually correspond as described above. For illustration the foot markings 28*f*, 30*f* may be designated by arrows of the same color, say black.

The number of foot markings 28, 30 may vary, and the spacing may vary. In the depicted embodiment the black foot marking 28*f* is closest to the end 18, and is about 11 inches from the end. Foot marking 28*e* is about 12 inches from the end. Foot marking 28*d* is about 13 inches from the end. Foot marking 28*c* is about 14 inches from the end. Foot marking 28*b* is about 16 inches from the end. Foot marking 28*a* is about 17 inches from the end. For a right handed golfer, markings 28 designate the left foot alignment position. For a left handed golfer, the foot markings 28 would denote the right foot alignment positions. The Foot marking 30*a* is about 29 inches from end 18, marking 30*b* is about 30 inches from end 18, marking 30*c* is about 31 inches from end 18, marking 30*d* is about 32 inches from end 18, marking 30*e* is about 33 inches from end 18 and marking 30*f* is about 34 inches from end 18. For a right handed golfer, foot markings 30 designate the right foot alignment position. For a left handed golfer, the foot markings 30 would denote the left foot alignment positions.

As noted, the foot markings 28, 30 are positioned relative to the club markings 26 and are preferably centered on and symmetrically spaced along the length of alignment guide 12, about the club marking location for one of the angled irons, preferably the 8 or 9 iron. Thus, the innermost foot markings 28*a*, 30*a* may be equal-distant from the club marking for the 8-9 iron and on the opposing side or edge 22 of the alignment guide than is the club marking 26, with successive foot markings 28, 30 extending toward opposing ends of the alignment guide at equal increments. The closest foot markings in each group 28, 30 are preferably about one foot apart with the farthest foot markings being 24-28 inches apart, preferably 26 inches apart, although other minimum and maximum spacing may be used.

The foot markings 28, 30 preferably extend along a majority (over half) of the length of the alignment guide, and less preferably extend along less than half the length. The length of the foot markings 28, 30 is measured between the marking 28 closes to the end 18 and the marking 30 closest to end 19 for a right handed golfer, which markings should be paired. As best seen in FIG. 1, the foot marking 28*d* (third from last) roughly aligns with one end of the club marking 26*a* for drivers with the club marking 28*b* roughly aligning with the other end of the club marking 26*a*, in the depicted embodiment.

The foot markings 28, 30 may be viewed as a plurality of sets of paired foot markings with each set including one marking 28*i* and the comparable marking 30*i*, such as 28*a*, 30*a*. Each set of paired markings 28*i*, 30*i* are on the upper surface 14 at or adjacent to the second edge 20. The paired foot markings 28*i*, 30*i* are centered on the location for one of the club markings 26, and advantageously centered on the location for one of the markings for the irons 26*d*, specialty wedges 26*e* or specialty shot heads 26*f*, and preferably centered on the location for the 8 or 9 iron. The paired foot markings 28*i*, 30*i* are equally spaced along the length of the alignment guide 12 from the location of the centered club marking, with each pair of foot markings differing in distance they are apart from the adjacent pair of foot markings by a fixed distance which is two inches in the described embodiment.

The foot markings 28, 30 are equally spaced apart from a common location preferably selected as the location of the club marking 26 for the 9 iron or pitch wedge. The foot markings could be centered near that preferred location, but are preferably centered on one of the club markings for an iron, and less preferably on the markings for a swing wedge, long wedge, or the adjacent initial portion of the markings for the specialty shots. The foot markings 28, 30 help balance the golfer's stance. The centering of the foot markings relative to a particular club marking 26 positions the location in the user's swing at which the ball will be contacted.

In use, a golfer lays the alignment guide 12 on the ground and points the alignment end 18 toward the location the ball is desired to travel, say the flag in the cup of the first hole for illustration. For right handed golfers the alignment end 18 would be the left end of the guide as shown in FIGS. 1, 2 and 4. The golfer places the golf ball along the length of the alignment guide 12 at the location that corresponds with the club being used to hit the ball, say the driver for illustration. Alternatively described, the ball is placed along the club marking 26 corresponding to the club being used, but the ball position is offset from the alignment guide 12. The ball is thus placed a few inches away from the alignment guide to avoid striking the alignment guide 12. A distance of about 2-4 inches is believed suitable, realizing there is some variability with visual estimation of distances. Thus, the ball would be about 3 inches away from the alignment guide 12, somewhere along the length of area 26*a* corresponding to the driver area. Advantageously, a written, visual description of each club position is provided on or adjacent to the club area, as shown in FIG. 1 to make it easier for the user to identify each marking area and associate it with the desired clubs.

The golfer then places his or her feet so each foot is aligned with corresponding foot markings in the left and right group and the same distance from the alignment guide. For illustration, a golfer may align the inside of his or her shoe with the innermost foot guides 28*a*, 30*a*. Visual positioning and alignment are believed sufficient. The golfer then moves toward or away from the alignment guide 12 a distance suitable or comfortable for the golfer to address and strike the ball, while maintaining the left and right foot in alignment with the corresponding foot marking indicia. The golfer's feet are advantageous perpendicular to the alignment guide 20 during use. Visual positioning and alignment are believed sufficient. The golfer then swings the club and hits the ball. Thus, the golf ball is on one side of the alignment guide 12 and the golfer on the other side of the guide. The golf ball is at a location predetermined by the alignment guide and its club markings 26 to position the ball along the length of the guide 12 for the club being used. The foot markings 28, 30 position the golfer relative to the alignment guide 12 and club markings 26, and thus relative to the ball. The foot markings 28, 30 also provide an equal foot spacing for balance, and position the golfer's body relative to the guide 12. Since the golfer determines which portion of the shoe or foot to align with the foot markings 28, 30 the golfer may position himself or herself at various positions along the length of the alignment guide 12. But as long as the golfer is consistent with the foot positions the golfer should be able to sort out which alignment position produces the best trajectory for a consistently swung club.

The alignment end 18 acts as an arrow to indicate the desired trajectory of a correctly hit ball. The length of the alignment guide 12 helps "aim" the alignment guide with longer lengths usually making it easier to align things. The alignment guide 12 acts as an arrow pointing toward the goal (e.g., the first hole). The orientation of the alignment guide 12 also helps orientate the golfer relative to the desired ball trajectory if the ball were hit straight.

The club markings 26 position the ball to help achieve the desired trajectory for the desired club being used to strike the ball. For club markings 26 that extend along a length of the alignment guide 12, positioning the ball toward the front of the club marking 26 (the end closer to end 18) should allow the club head to engage the ball so as to produce a lower trajectory, while positioning the ball toward the back of the same club marking 26 should result in a higher trajectory of the ball. Balls positioned toward the front end of the ball marking length 26*a*, 26*b*, 26*c* and 26*f* should contact the club head later in the swing and thus have a lower trajectory. Balls toward the back end of the ball marking length 26*a*, 26*b*, 26*c* and 26*f* should contact the club head earlier in the swing and thus have a higher trajectory or loft. Actual performance may vary with the swing of the individual golfer but a consistent swing should produce consistent results.

The foot markings 28, 30 align the golfer's feet and body relative to the alignment guide 12 and thus relative to the ball. The equal spacing of corresponding foot markings 28, 30 helps ensure an equally balanced stance relative to the alignment guide and thus relative to the ball and relative to the club guide markings 26, and further relative to the alignment guide 12 and the desired trajectory of the ball if it is hit straight. Consistent use of the alignment guide 12 should result in consistent performance when the club is swung consistently. Varying the ball position along the length of the club markings 26 or relative to the discrete club marking 26 should consistently vary the ball trajectory when the club is swung consistently.

Of the myriad of factors that can affect the ball trajectory, the alignment guide focuses only on a few factors. It helps align and position the golfer relative to the desired trajectory, it helps to position the ball relative to the specific club being used, and it helps to obtain a balanced stance and alignment relative to the desired trajectory of the ball. By selecting a sub-group of the multitude of parameters that affect the performance of hitting a golf ball, and by providing an alignment guide that helps achieve a desirable or consistent implementation of those factors, in a simple to understand and simple to use manner, it is believed that a golfer can consistently hit the ball and improve the golfer's performance.

The alignment guide may have printed indicia 32 on the lower surface 16. Such printed indicia advantageously include information describing how to use the alignment guide, but could include promotional or advertising information and/or images.

The alignment guide as described is advantageously about 2-5 feet long, with a preferred length of about four feet. The alignment guide may be made of various materials, with PVC (polyvinyl chloride) being believed suitable because of its low cost, light weight and flexibility. Depending on the material from which the alignment guide 12 is made the guide may optionally be coated with material to display printed indicia described below. For example, a coating may be desirable on PVC to enable easy printing of the various markings 18, 26, 28, and 30. The markings are preferably on the upper surface 14 of the alignment guide, but may extend onto or be located on the opposing sides or edges 20, 22.

The markings 26, 28, 30 are formed by printed indicia, with the club markings 26 being at or adjacent to the edge 20 for a right handed golfer and at or adjacent to the edge 22 for a left handed golfer. As used herein, the term "adjacent to" means on the half of the upper surface closest to the edge, such that adjacent to edge 20 means on the half of the upper surface 14 that is closest to the edge 20. As used herein, the term "about" when referring to the location or length of club markings 26 or foot markings 28, 30 means within 15% of the specified dimension, plus or minus.

The markings 26, 28, 30 may include indentations in the edge 20 or 22 indicative of the beginning, end, or location of the various information conveyed by the markings. Thus, the foot markings 28, 30 could include indentations in the edge 22, and preferably those indentations are visible on the upper surface 14. Likewise, club markings 26 could include indentations in edge 20 that are preferably visible on upper surface 14. As used herein, if the upper surface 14 includes curved configurations such as a semicircle and also includes inclined surfaces ending at the lower surface 16 or side edges 20, 22 with club markings 26 on a first inclined surface and foot markings 28, 30 on a second inclined surface.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A method for aligning a golfer with a ball, comprising the steps of:

placing an elongated alignment guide on the ground with a longitudinal axis of the alignment guide aligned with the desired trajectory of a golf ball, the alignment guide having a series of club markings along a first edge identifying the location at which the ball should be placed when using a specified club, the club markings including one or more of drivers, fairway woods, 4 iron or hybrids, 5 to 9 irons, wedges, and clubs for specialty shots not included in the other club heads;

placing a golf ball in the club marking corresponding to the club being used to hit the ball, but offset from the alignment guide by a few inches;

standing on the opposite side of the alignment guide as the ball, the alignment guide having a second side oppose the first side with a plurality of paired foot markings along the second side, the paired foot markings equidistant from and centered on the location for the 8 or 9 iron or a wedge;

aligning a corresponding location on each of the golfer's feet with a different one of a pair of the foot markings; and swinging the club and hitting the ball.

2. The method of claim 1, wherein the club markings include a marking for one of 8 irons, 9 irons or pitching wedges, and wherein the foot markings are centered on the marking for a pitching wedge.

3. The method of claim 1, the foot markings are centered on the club marking for the 8 iron.

4. The method of claim 1, the foot markings are centered on the club marking for the 9 iron.

5. The method of claim 1, the foot markings are centered on a club marking for a specialty wedge.

* * * * *